US008584683B2

(12) United States Patent
Shammami

(10) Patent No.: US 8,584,683 B2
(45) Date of Patent: Nov. 19, 2013

(54) APPARATUS AND METHOD FOR REMOVING FINGERNAIL POLISH

(76) Inventor: Sheila Shammami, West Bloomfield, MI (US)

( * ) Notice: Subject to any disclaimer, the term of this patent is extended or adjusted under 35 U.S.C. 154(b) by 56 days.

(21) Appl. No.: 13/028,708

(22) Filed: Feb. 16, 2011

(65) Prior Publication Data

US 2012/0204892 A1 Aug. 16, 2012

(51) Int. Cl.
*A45D 29/00* (2006.01)

(52) U.S. Cl.
USPC ..... 132/73; 15/244.1; 15/244.4

(58) Field of Classification Search
USPC ..... 132/73, 73.5, 75.3, 75.6, 76.4; 15/167.3, 244.1, 244.4; 215/383, 384, 215/382; 220/675, 670, 669
See application file for complete search history.

(56) References Cited

U.S. PATENT DOCUMENTS

| | | | | | |
|---|---|---|---|---|---|
| 838,440 | A | * | 12/1906 | Neff | 132/75.4 |
| 1,942,935 | A | * | 1/1934 | Reutter | 220/4.21 |
| 2,013,243 | A | * | 9/1935 | Landon | 222/465.1 |
| 2,118,388 | A | * | 5/1938 | Zerbe | 228/105 |
| 2,461,695 | A | * | 2/1949 | McMahon | 132/73 |
| 2,494,414 | A | * | 1/1950 | Snider | 132/75.6 |
| 2,540,625 | A | * | 2/1951 | Loomis | 132/75.6 |
| 2,620,919 | A | * | 12/1952 | Passmore | 206/83 |
| 2,713,693 | A | | 7/1955 | Johnson | |
| D180,355 | S | * | 5/1957 | Blackburn | D32/51 |
| 2,841,811 | A | * | 7/1958 | Carroll | 15/244.1 |
| 2,917,766 | A | * | 12/1959 | Ciffo | 206/15.2 |
| 3,086,241 | A | * | 4/1963 | Bohn | 401/9 |
| 3,137,880 | A | * | 6/1964 | Kubit et al. | 15/244.1 |
| 3,317,944 | A | * | 5/1967 | Napier et al. | 15/244.1 |
| 3,319,281 | A | * | 5/1967 | Montgomery | 15/244.1 |
| D271,817 | S | * | 12/1983 | Collin | D32/40 |
| 4,627,129 | A | | 12/1986 | Wittes | |
| 4,628,564 | A | * | 12/1986 | Youssef | 15/167.1 |
| 4,757,571 | A | * | 7/1988 | Young | 15/167.3 |
| 4,975,999 | A | * | 12/1990 | Levy | 15/210.1 |
| 5,027,839 | A | | 7/1991 | Appell | |
| 5,442,829 | A | * | 8/1995 | Summers | 15/106 |
| 5,500,049 | A | * | 3/1996 | Kolinsky | 134/6 |
| 5,567,070 | A | * | 10/1996 | Ficcadenti | 401/7 |
| 5,836,034 | A | * | 11/1998 | Galvan Garza | 15/118 |
| 5,915,869 | A | * | 6/1999 | Agosto et al. | 401/201 |
| 6,575,172 | B1 | | 6/2003 | Crosby | |
| 6,601,591 | B1 | * | 8/2003 | Carullo et al. | 132/320 |
| 8,230,544 | B2 | * | 7/2012 | Leshko | 15/160 |
| 2001/0029967 | A1 | * | 10/2001 | McDonough | 134/6 |
| 2003/0208866 | A1 | * | 11/2003 | Parks | 15/118 |
| 2004/0031818 | A1 | * | 2/2004 | Killoran et al. | 222/212 |
| 2006/0010634 | A1 | * | 1/2006 | Moser et al. | 15/244.4 |
| 2006/0027585 | A1 | * | 2/2006 | Clamage | 220/669 |
| 2006/0243291 | A1 | * | 11/2006 | Daley | 132/73 |
| 2009/0276971 | A1 | * | 11/2009 | Nozari | 15/118 |

* cited by examiner

*Primary Examiner* — Robyn Doan
*Assistant Examiner* — Tatiana Nobrega
(74) *Attorney, Agent, or Firm* — John Chupa

(57) ABSTRACT

A disposable nail polish removing device 12 for removing nail polish and other debris from a finger or toe nail. The nail polish removing device 12 is generally spherical and has one or more indentations 18 for grasping the device. One or more operational areas 24, 26 on the remaining surface 22 of the device may be used to facilitate the absorption and application of a cleaning fluid when one of the operational areas is juxtaposed with a finger or toe nail. The nail polish removing device 12 may be a sponge.

1 Claim, 3 Drawing Sheets

APPARATUS AND METHOD FOR REMOVING FINGERNAIL POLISH

TECHNICAL FIELD

This invention relates to cosmetic devices.

BACKGROUND

Various cosmetic devices have been used over the years for the absorption and application of a nail polish removing solution. The most common of these devices is a cotton ball soaked in either acetone or non-acetone nail polish remover. When the cotton ball is juxtaposed with a finger or toe nail and compressed with force from the user against the nail, it provides means for depositing a nail cleaning fluid and absorbing nail polish and other debris that existed on the nail prior to the application. Traditional cotton balls are soft by nature. They are easily divided or changed in shape. Particles of lint or small strands of cotton may be deposited on the nail surface during cleaning. The cotton ball slowly disintegrates during use making it difficult to use a single cotton ball to complete the removal of nail polish from all five nails on either a hand or foot at one time. Also, the lint or small strands of cotton left on the nail after the removal of the nail polish still need to be removed from the nail surface prior to continuing the manicure thus adding the extra step of washing the nails thoroughly prior to continuing the manicuring process.

It is known that many cosmetology professionals, including manicurists, have developed symptoms of carpal tunnel. Carpal tunnel may cause the professional to experience pain, tingling, pricking, numbness, or weakness in the fingers of their hands. Presently, many cosmetology professionals utilize a traditional cotton ball for the removal of nail polish from finger or toe nails and the pinching motion necessary to grasp an easily deformed cotton ball can severely aggravate symptoms of carpal tunnel. A need arises for a nail polish removing device that has the ability to hold its shape while still providing both the cleaning fluid absorption and deposit and the abrasive characteristics necessary to facilitate the easy removal of nail polish from a finger nail or a toe nail.

Among the references considered before filing this application are: U.S. Pat. No. 2,713,693 to Johnson, U.S. Pat. No. 2,841,811 to Carroll, U.S. Pat. No. 4,627,129 to Wittes, U.S. Pat. No. 5,027,839 to Appell, and U.S. Pat. No. 6,575,172 B1 to Crosby.

SUMMARY

In one embodiment a nail polish removing device to be used by a practitioner on a customer has at least one indentation on a generally spherical body. The one or more indentations can be used to grasp the device while the remaining surface of the device can be used for nail cleaning purposes by being capable of both absorbing and applying a cleaning fluid while simultaneously absorbing nail polish from a finger or toe nail.

In another embodiment a nail polish removing device made of a sponge material that is dimensionally sized to be held by a non-closed hand has an external surface capable of facilitating the removal of debris deposits from on and under a finger or toe nail. The device comprises a plurality of indentations that may be used by a practitioner for grasping the device while limiting the effects of carpal tunnel.

In still another embodiment a nail polish removing device comprising a convex body has at least one concave finger-well and is capable of retaining and dispensing a cleaning fluid. A transition surface between the convex body and the concave finger-well provides a blunt cleaning edge for cleaning various regions of the finger or toe nail.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
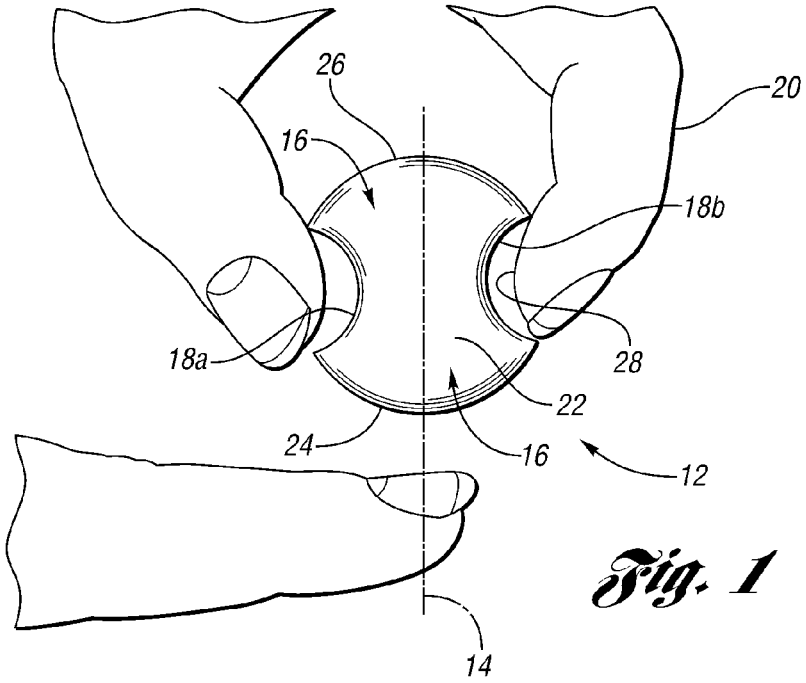
FIG. 1 is a perspective view of a nail polish removing device.

FIG. 1 shows a disposable nail polish removing device 12 that is generally spherical in shape. Longitudinal axis 14 is oriented generally vertical and runs through the center of nail polish removing device 12. A pair of opposing pole areas 16 are joined by the longitudinal axis 14. Generally aligned with longitudinal axis 14 are one or more indentations 18. The one or more indentations 18 are shaped to facilitate the engagement of the fingers 20 of a practitioner. A practitioner may use the one or more indentations 18 to grasp the disposable nail polish removing device 12 between any two fingers. The device 12 is capable of retaining its original shape throughout the nail cleaning process. Although it may be compressed during use its resilient nature allows it to spring back to its original generally spherical shape. A remaining surface 22 lies outside the one or more indentations 18 on the nail polish removing device 12. The pole areas 16 exist within the remaining surface 22. Also disposed on the remaining surface 22 at one of the two opposing pole areas 16 is a first operational area 24 that can be used to absorb and apply a nail cleaning fluid. A cleaning fluid may include, but is not limited to, an organic solvent, oil, water, liquid soap, acetone, non-acetone polish remover containing ethyl acetate, or acetonitrile. A second operational area 26 is disposed at the second pole area 16 that lies opposite to the first operational area 24 and can also be used to both absorb and apply a cleaning fluid once the first operational area 24 becomes soiled. As the nail polish removing device 12 becomes soiled at both the first 24 and the second 26 operational areas, one of the one or more indentations 18, or any part of the remaining surface 22 may be rotated in to use such that when one of the previously mentioned regions is juxtaposed with a finger or toe nail and it can be used to facilitate the cleaning of a finger or toe nail. This rotate-ability of the device adds additional operational areas for cleaning use.

The one or more indentations 18 may be sized to receive the finger tip of a practitioner 28. In one embodiment of the device the one or more indentations 18 includes two indentations 18*a*, 18*b* which are generally diametrically disposed on the nail polish removing device 12 and parallel to the longitudinal axis 14 of the device.

Figure 2:
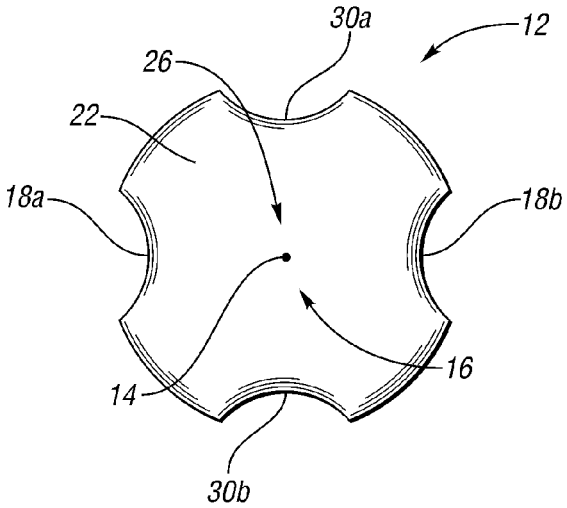
FIG. 2 is a top view of a nail polish removing device with four indentations.

The nail polish removing device as illustrated in FIG. 2 shows another embodiment of the device 12 which includes four indentations 18*a*, 18*b*, 30*a*, and 30*b*. One or more of the indentations may be used by the practitioner to grasp the device 12 during use. The four indentations 18*a*, 18*b*, 30*a*, and 30*b* are aligned generally parallel to longitudinal axis 14 and disposed about equally around the device 12. In the event that the operational areas 24 and 26 of the device 12 become soiled, one or more of the four indentations 18*a*, 18*b*, 30*a*, and 30*b*, as well as any part of the remaining surface 22, can be rotated into use such that when one of the four indentations 18*a*, 18*b*, 30*a*, and 30*b* or part of the remaining surface 22 is juxtaposed with a finger or toe nail it can be used to facilitate the cleaning of a finger or toe nail.

Figure 3:
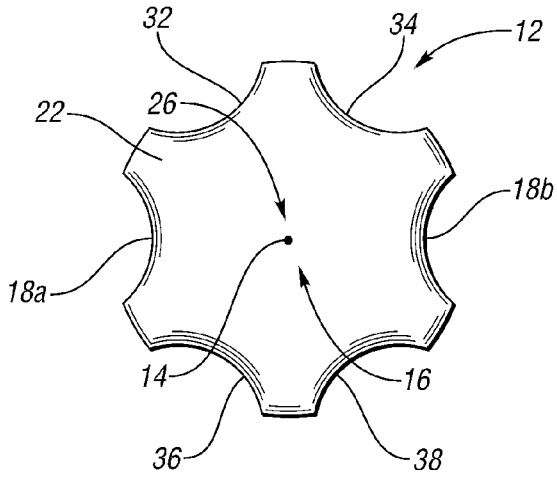
FIG. 3 is a top view of a nail polish removing device with six indentations.

The nail polish removing device as illustrated in FIG. 3 shows another embodiment of the device 12 in which there are six indentations 18*a*, 18*b*, 32, 34, 36, and 38. One or more of the indentations may be used by the practitioner to grasp the device 12 during use. The six indentations 18*a*, 18*b*, 32, 34, 36, and 38 are aligned generally parallel to longitudinal axis 14 and disposed about equally around the device 12. In the event that the operational areas 24 and 26 of the device 12 become soiled, one or more of the six indentations 18*a*, 18*b*, 32, 34, 36, and 38, as well as any part of the remaining surface 22, can be rotated into use such that when one of the six indentations 18*a*, 18*b*, 32, 34, 36, and 38 or any part of the remaining surface is juxtaposed with a finger or toe nail it can be used to facilitate the cleaning of a finger or toe nail.

Figure 4:
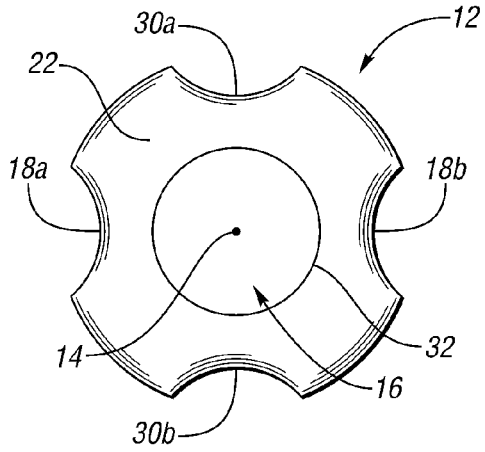
FIG. 4 is a top view of a nail polish removing device showing four side indentations and a top indentation.

FIG. 4 shows the nail polish removing device 12 with six indentations. Four of the indentations 18*a*, 18*b*, 30*a*, and 30*b* are aligned generally parallel to longitudinal axis 14 and disposed about equally around the device 12. Two additional indentations 32, second additional indentation not shown, are added to device 12 at the pole areas 16 through which longitudinal axis 14 runs. One or more of the indentations may be used by the practitioner to grasp the device 12 during use. In this embodiment of the nail polish removing device any of the six indentations, as well as any part of the remaining surface 22, can be juxtaposed with a finger or toe nail and used to facilitate the cleaning of a finger or toe nail through both the absorption and application of a cleaning fluid.

Figure 5:
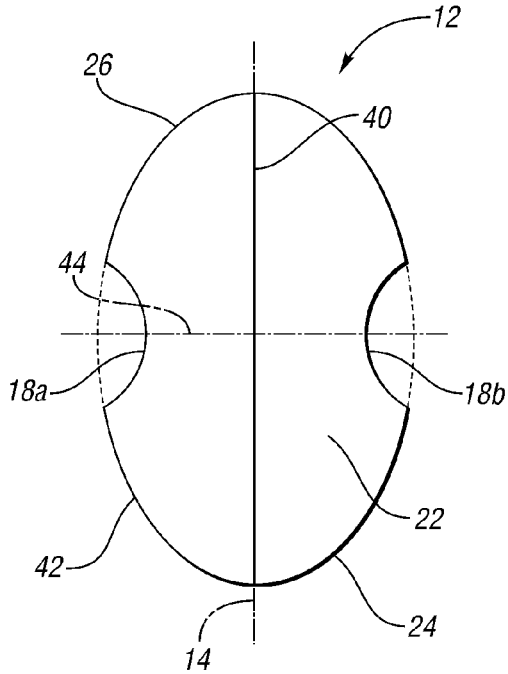
FIG. 5 is a perspective view of a prolate nail polish removing device.

FIG. 5 shows the nail polish removing device 12 as generally prolate. The prolate shape of the device 12 is made by aligning the longer diameter 40 of ellipse 42 with longitudinal axis 14 and rotating ellipse 42 about longer axis 40 until a prolate spheroid is formed. Indentations 18*a* and 18*b* may be positioned such that the short axis 44 of device 12 is both adjacent to and runs through the center of the indentations. In the event that operational areas 24 and 26 become soiled, the remaining surface 22 of the prolate device may be used to facilitate the cleaning of a finger or toe nail when the remaining surface 22 is juxtaposed with a finger or toe nail.

Figure 6:
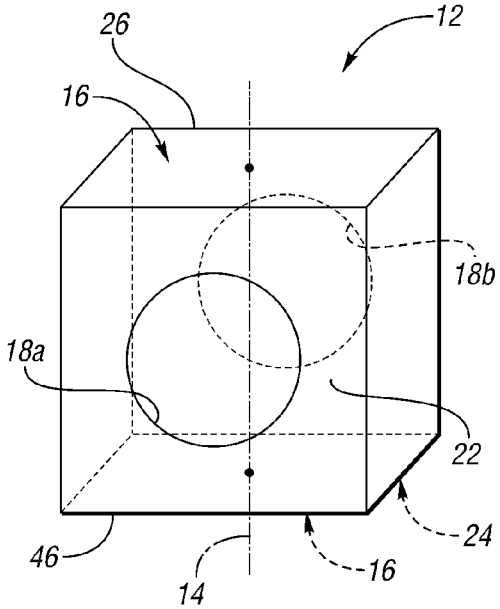
FIG. 6 is a perspective view of cubical nail polish removing device.

FIG. 6 shows the nail polish removing device 12 as generally cubical. The cubical nature of device 12 allows for indentations 18*a* and 18*b* to not only be placed generally parallel with the vertically oriented longitudinal axis 14, as depicted in FIG. 6, but also to be placed on any of the six sides of device 12. Operational areas 24 and 26 are shown as being on the pole areas 16 of cube 46 but it is also possible to use any remaining surface 22 of cube 46 to facilitate the cleaning of a finger or toe nail when the remaining surface 22 is juxtaposed with a finger or toe nail.

Figure 7:
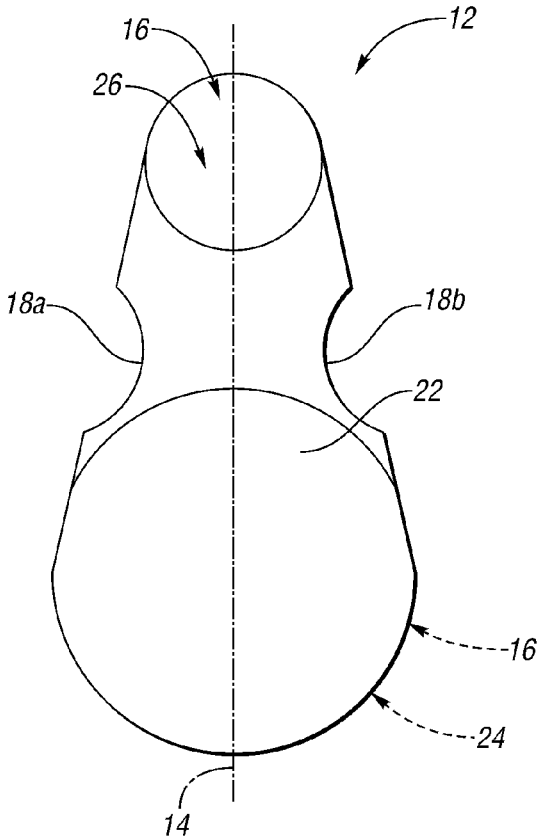
FIG. 7 is a perspective view of a frusto-conical nail polish removing device.

FIG. 7 shows the nail polish removing device 12 as generally frusto-conical. A frusto-conical shape may be defined as a tip truncation of a cone by a plane that is parallel to its base. Longitudinal axis 14 is generally vertical and runs through the center of the pole areas 16 of device 12. The base of the frusto-cone is defined as the largest of pole areas 16 and the tip is the smallest of pole areas 16. Two indentations 18*a* and 18*b* are oriented generally parallel to longitudinal axis 14 and on opposing sides of device 12. A first operational area 24 may lie within the largest of the pole areas 16 and a second operational area 26 may lie opposite the first operational area 24 and within the smallest of the pole areas 16. In the event that operational areas 24 and 26 become soiled, the one or more indentations 18 or any part of the remaining surface 22 of the frusto-conical device 12 may be used to facilitate the cleaning of a finger or toe nail when juxtaposed with a finger or toe nail.

Figure 8:
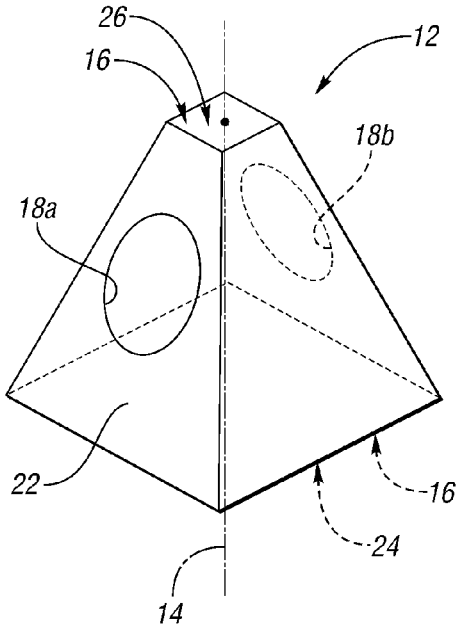
FIG. 8 is a perspective view of a frusto-pyramidal nail polish removing device.

FIG. 8 shows the nail polish removing device 12 as generally frusto-pyramidal. A frusto-pyramidal shape may be defined as a tip truncation of a pyramid by a plane that is parallel to its base. Longitudinal axis 14 is generally vertical and runs through the center of the pole areas 16 of device 12. The base of the frusto-pyramid is defined as the largest of pole areas 16 and the tip is the smallest of pole areas 16. Two indentations 18*a* and 18*b* lie generally parallel to longitudinal axis 14 on opposing side of nail polish removing device 12. The two indentations 18*a* and 18*b* are shown to be on opposing sides of the device 12; however the indentations may be placed on any side of the frusto-pyramidal that lies outside the pole areas 16. A first operational area 24 may lie within the largest of the pole areas 16 and a second operational area 26 may lie opposite the first operational area 24 and within the smallest of the pole areas 16. In the event that operational areas 24 and 26 become soiled, the one or more indentations 18 or any part of the remaining surface 22 of the frusto-pyramidal device 12 may be used to facilitate the cleaning of a finger or toe nail when juxtaposed with a finger or toe nail.

Figure 9:
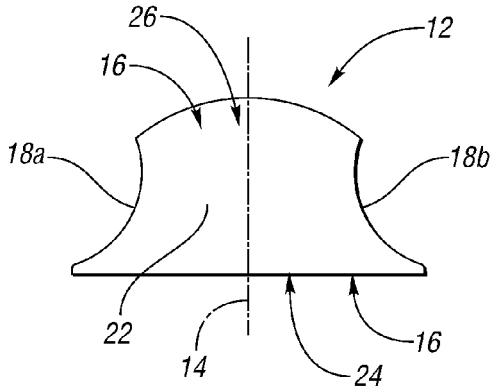
FIG. 9 is a perspective view of a hemispherical nail polish removing device.

FIG. 9 shows the nail polish removing device 12 as generally hemispherical. A hemisphere may be defined as half a sphere that has been separated by a plane through its center. Longitudinal axis 14 is generally vertical and runs through the center of the pole areas 16 of device 12. The base of the hemisphere is defined as the flat pole area 16. Two indentations 18*a* and 18*b* lie generally parallel to longitudinal axis 14 on opposing sides of nail polish removing device 12. A first operational area 24 may lie within the base pole area 16 and a second operational area 26 may lie opposite the first operational area 24 and within the second opposing pole area 16. In the event that operational areas 24 and 26 become soiled, the one or more indentations 18 or any part of the remaining surface 22 of the hemispherical device 12 may be used to facilitate the cleaning of a finger or toe nail when juxtaposed with a finger or toe nail.

Figure 10:
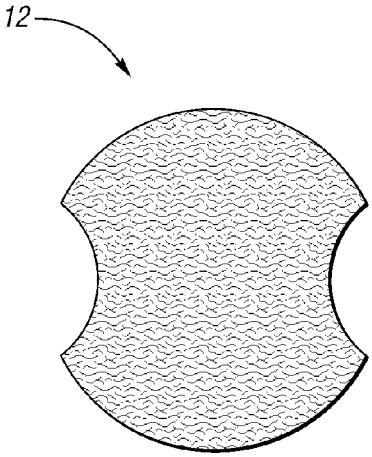
FIG. 10 is a perspective view of a sponge nail polish removing device.

FIG. 10 depicts the nail polish removing device 12 as a sponge. The sponge may be made of the group including, but not limited to, naturally occurring sponges, manmade sponges, or cellular foam. Sponges are known for their porous nature. A sponge allows for a practitioner to absorb a cleaning fluid from a cleaning fluid dispenser, apply the cleaning fluid to a nail surface, and then absorb the cleaning fluid along with the removed nail polish and other debris from the nail. A sponge will retain toughness and shape throughout the manicuring process.

Figure 11:
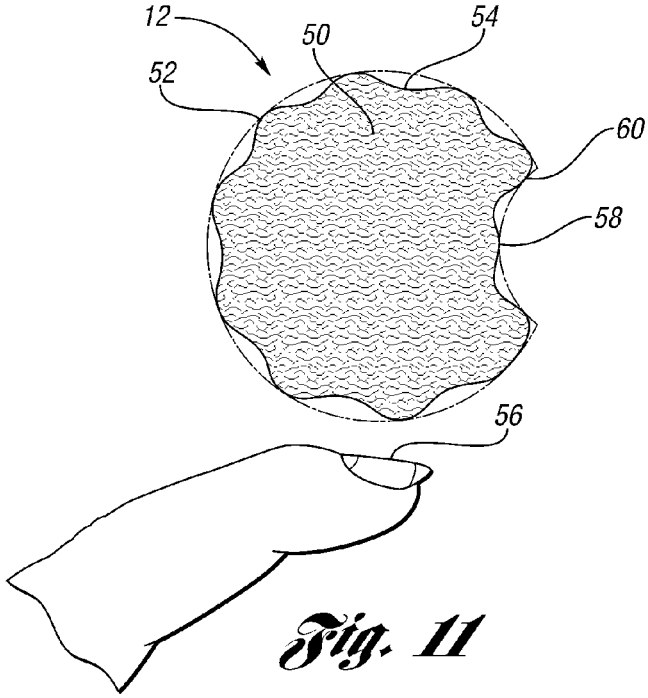
FIG. 11 is a perspective view of a substantially concave nail polish removing device showing a fluid in retention.

FIG. 11 illustrates a nail polish removing device 12 comprising a substantially convex body 50. The substantially convex body defines a convex surface 52. The convex body 50 has means to retain a fluid 54 in communication with the convex surface 52. The fluid 54 within the convex body is capable of being deposited on to a substrate 56. To facilitate easy grasping of the nail polish removing device 12 at least one concave finger-well 58 is disposed on and partially below the surface of the convex body 52. A transition surface 60 is provided between the convex surface 52 and the concave finger-well 58. The transition surface 60 is a blunt edge that is capable of providing means for cleaning difficult to reach regions of a finger or toe nail including but not limited to, a cuticle region or under the nail surface.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, features of various implementing embodiments may be combined to form further embodiments of the invention.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

What is claimed is:

1. A hand held nail polish removing device consisting of:

a frusto-pyramidal body having a square bottom wall, a square top wall and four isosceles trapezoid side walls where the frusto-pyramidal body is made of an absorbent material which allows the body to compress during use and resiliently return to its original frusto-pyramidal shape;

wherein the frusto-pyramidal body has two generally hemispherical indentations and first and second operational areas;

said generally hemispherical indentations being diametrically disposed on opposed side walls of the frusto-pyramidal body providing a surface for engagement of a user's fingers therein for grasping the device, wherein the indentations define a blunt outer edge surface adapted to clean under a nail, a cuticle region and other difficult to reach regions of a finger or toe nail;

said first and second operational areas being diametrically disposed along the longitudinal axis of the frusto-pyramidal body;

a nail polish removing fluid absorbed within the first and second operational areas of the frusto-pyramidal body, said nail polish removing fluid selected from the group consisting of: acetone or non-acetone polish remover containing ethyl acetate or acetonitrile.

* * * * *